US005243776A

United States Patent [19]

Zelinko

[11] Patent Number: 5,243,776

[45] Date of Patent: Sep. 14, 1993

[54] GOLF SHOE CONSTRUCTION

[76] Inventor: Anthony P. Zelinko, 1880 N. 5 Mile Rd., Sanford, Mich. 48657

[21] Appl. No.: 847,584

[22] Filed: Mar. 5, 1992

[51] Int. Cl.[5] ..... A43B 5/00; A43B 5/02

[52] U.S. Cl. ..... 36/134; 36/127

[58] Field of Search ..... 36/126, 127, 128, 134, 36/8.3, 1, 39, 131, 67 R, 59 R

[56] References Cited

U.S. PATENT DOCUMENTS

| | | | |
|---|---|---|---|
| 1,304,616 | 5/1919 | Smith | 36/127 |
| 1,362,225 | 12/1920 | Carlslund . | |
| 2,107,617 | 2/1938 | Oetterer . | |
| 2,109,712 | 3/1938 | Schmalz | 36/39 |
| 2,206,136 | 7/1940 | Tchetchet . | |
| 3,081,562 | 3/1963 | Oakley . | |
| 3,091,043 | 5/1963 | McCorkle . | |
| 3,204,348 | 9/1965 | Latson . | |
| 3,354,561 | 11/1967 | Cameron . | |
| 3,481,332 | 12/1969 | Arnold | 36/39 |
| 3,680,231 | 8/1972 | Dymond | 36/59 R |
| 3,707,047 | 12/1972 | Nedwick | 36/134 |
| 3,739,497 | 6/1973 | Cameron | 36/134 |
| 4,309,832 | 1/1982 | Hunt | 36/31 |
| 4,562,651 | 1/1986 | Frederick et al. | 36/102 |

FOREIGN PATENT DOCUMENTS

| | | | |
|---|---|---|---|
| 2011134 | 9/1971 | Fed. Rep. of Germany | 36/128 |
| 581 | 5/1914 | United Kingdom | 36/7.5 |
| 239319 | 9/1925 | United Kingdom | 36/126 |

*Primary Examiner*—Steven N. Meyers

*Attorney, Agent, or Firm*—Learman & McCulloch

[57] ABSTRACT

A golfer's shoe having a spike-supporting plate pivoted to the shoe sole for rotation about an axis. The plate is biased to a neutral position by yieldable springs which enable relative rotation in each of two opposite directions between the spikes and the shoe sole and return the spikes to the neutral position following completion of the golf stroke.

14 Claims, 1 Drawing Sheet

GOLF SHOE CONSTRUCTION

This invention relates to an athletic shoe and more particularly to a golf shoe having spikes carried by a support plate which is pivoted to the shoe sole in such manner as to enable the support plate to rotate relative to the shoe about an axis.

BACKGROUND OF THE INVENTION

A conventional golf shoe has a foot-accommodating upper and a sole and heel secured to the upper. Both the sole and the heel carry spikes which become embedded in the ground when the shoe is worn so as to minimize the shoe's slipping whenever the wearer walks or executes a golf stroke. The restraint against slipping or other movement of the shoe relative to the ground is advantageous when the wearer is walking, but restraining movement of the golfer's foot in the execution of a golf stroke is not believed to be conducive to executing the most efficient and powerful stroke.

Historically movement of a golfer's feet, other than lifting of the heel closer to the target area, during the execution of a golf stroke has been considered undesirable. However, keeping golfer's feet fixed as the arms, torso, and legs rotate imposes strains on the golfer's ankles, knees, hips, back, and shoulders which not only cause discomfort, but also risk injury over prolonged periods of time. In addition, preventing rotation of the golfer's feet relative to the ground during the execution of a golf stroke imposes limitations on the extent to which other parts of the golfer's body may turn or rotate, as well as on the freedom with which such other parts of the body may turn.

A shoe constructed in accordance with the invention provides for non-slip engagement between a golfer's shoe and the ground, but enables the shoe to rotate relatively to the ground, thereby avoiding the imposition of restraining forces on the player's body during the execution of a golf stroke.

SUMMARY OF THE INVENTION

A golf shoe constructed in accordance with the invention comprises an upper secured to a sole or bottom having a forward end, a rearward end, and an intermediate portion joining the two ends. Mounted on the forward end of the sole for rotation about a vertical axis is a spike support plate having spikes which are adapted to be embedded in the ground in the conventional manner. Supported at the rearward end of the sole is a heel. Neither the heel nor the intermediate portion of the shoe sole has any spikes. The rockable spike-supporting plate is yieldably biased by one or more springs to a neutral position from which the plate is movable during the execution of a golf stroke and to which the plate is returned by the biasing springs following completion of the golf stroke and walking of the golfer.

THE DRAWINGS

DETAILED DESCRIPTION

Figure 1:
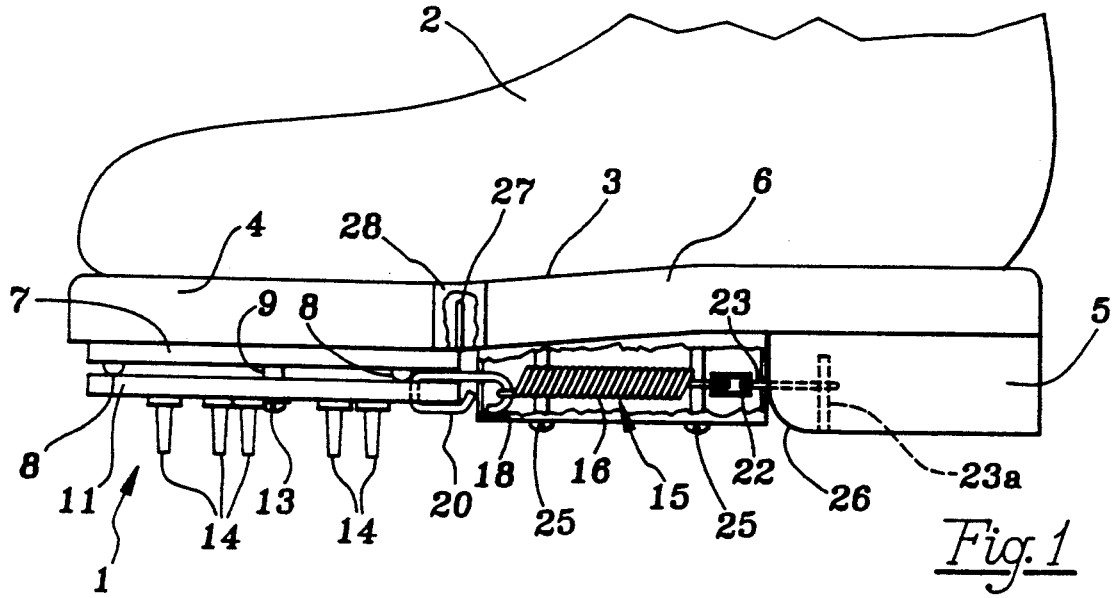
FIG. 1 is a side elevational view, with parts broken away, of a golf shoe constructed in accordance with one embodiment of the invention.
Figure 2:
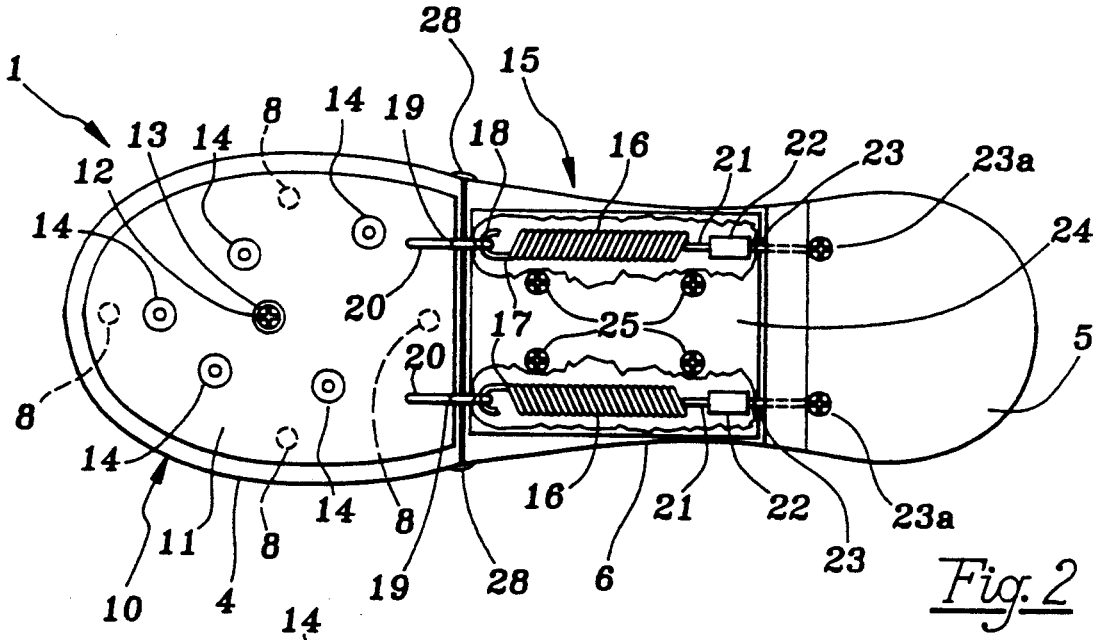
FIG. 2 is a bottom plan view, with parts broken away, of the embodiment shown in FIG. 1.

A shoe constructed in accordance with the embodiment of the invention shown in FIGS. 1 and 2 is designated generally by the reference character 1 and comprises a foot-accommodating upper 2 which is secured in a conventional manner to a shoe sole 3. The sole has a forward portion 4 for supporting the ball of a person's foot and a heel 5 at the rearward end for supporting a person's heel. An intermediate portion 6 extends between the forward end of the sole and the heel for supporting the arch of a person's foot.

Secured in any convenient and suitable manner to the forward portion of the sole 3 is an anchor plate 7 formed of metal or other suitable material. The plate 7 has a plurality of sockets in each of which is accommodated a ball or other appropriate bearing 8.

The anchor plate 7 has secured thereto a downwardly extending coupling or pivot post 9. Journaled on the post 9 for rotation about the axis thereof is a spike-support 10 comprising a plate 11 formed of metal or other suitable material and coupled to the post by means of a washer 12 and a screw 13. The plate 11 bears against the bearings 8 to ensure nonbinding rotation of the plate. The plate is not circular, but instead is parabolic at its forward end to conform substantially to the shape of the corresponding end of the sole.

The plate 11 carries a plurality of conventional golf spikes 14 which extend downwardly from the plate 11. The spikes 14 are spaced circumferentially from one another and radially from the axis of the coupling post 9 so as to provide a secure, non-slip engagement between the spikes and the ground. The arrangement of the spikes on the plate 11 is not symmetrical relative to the axis of the post 9, but rather is substantially parabolic so as to provide adequate resistance to relative rotation between the plate 11 and the ground.

Since the support plate 11 is not circular, rotation of the plate 11 in one direction or the other from the position shown in FIG. 2 will cause the forward and rear edges of the plate to extend beyond the confines of the sole 3. If the forward and rearward ends of the plate were permitted to extend beyond the sides of the sole when the wearer of the shoe is walking, the projecting ends of the plate could create interference. Further, permitting the ends of the support plate 11 to overhang the shoe sole perhaps would preclude the spikes' being located in the preferred position as the golfer addresses a ball in the preparation of executing a stroke.

Accordingly, biasing means 15 is provided for constantly biasing the spike-supporting plate 11 to a selected or neutral position and for returning such plate to that position after the plate has been rotated in either of two opposite directions from such position. The biasing means comprises a pair of parallel, spaced apart tension springs 16 the forward end 17 of each of which is formed as a hook and is accommodated in a loop 18 at one end of a connector 19, the other end 20 of which extends through an opening in the rearward end of the plate 11. The opposite end 21 of each spring 16 is connected to one end of a turnbuckle 22, the opposite end 23 of which is anchored in the heel 5 to a post 23*a*, although the posts 23 obviously could be secured in the intermediate portion 6 of the sole, if desired. The turnbuckles enable the applicable force of the springs to be adjusted.

To provide protection for the biasing means 15 a cover or shield 24 which overlies the major portions of the springs 16 and their associated parts and is secured to the shoe sole portion 6 by suitable screws 25.

The heel 5 is not provided with spikes, and the forward end of the heel is rounded or sloped to merge smoothly with the sole portion 6, thereby facilitating movement of the shoe and the wearer's foot relative to the ground when the wearer executes a golf stroke.

If desired, a groove 27 may be provided transversely of the sole portion 4 and rearwardly of the plate 11. The groove is open at the bottom of the sole and at each of its ends. The ends of the groove may be covered by an elastic material 28, such as Spandex, of known kind for aesthetic purposes. The presence of the groove 27 facilitates a golfer's walking while wearing the shoe.

Figure 3:
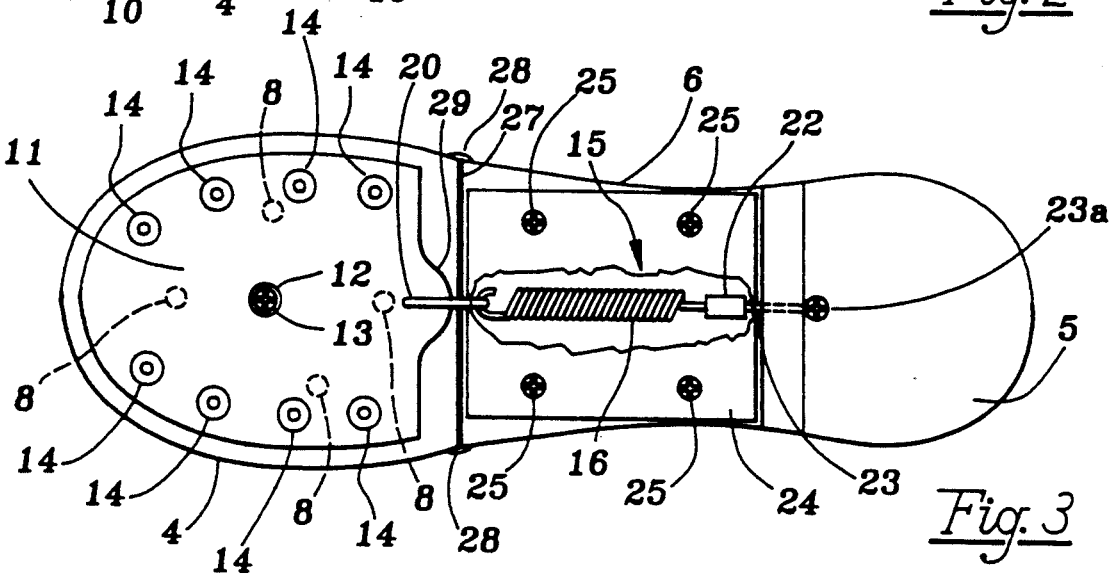
FIG. 3 is a view similar to FIG. 2 but illustrating a modified embodiment.

The embodiment shown in FIG. 3 corresponds in most respects to the embodiment shown in FIGS. 1 and 2, so corresponding parts are identified by corresponding reference characters. The principal difference between the two embodiments is that, in the embodiment of FIG. 3, the biasing means 15 comprises a single spring 16 which is centrally located between the sides of the intermediate sole portion 6. The spike-supporting plate 11 has a centrally located, rearwardly extending tongue 29 to which the forward end 20 of the coupling member 19 of the spring is joined. The single spring 16 of the FIG. 2 embodiment functions in the same manner as the two springs in the earlier described embodiment.

In use, a golfer wearing a pair of shoes like either of those disclosed herein will take his or her stance in the usual manner preparatory to executing a golf swing. In this position of the golfer, the spike-supporting plate 11 will occupy the position shown in FIG. 2 or 3, i.e., the neutral or initial position, in which the plate 11 is wholly within the confines of the sole.

As the golfer commences the execution of a golf stroke, the club will be moved rearwardly of the ball and the arms, shoulders, torso, hips, and legs of the golfer will rock or rotate with respect to the ground. The spike-supporting plate 11 and the spikes supported thereby will remain fixed with respect to the ground throughout the golf stroke while the shoes' uppers, soles, and heels rotate with the player's feet and legs.

Although the position of the spikes and plates 11 relative to the ground will remain unchanged during the execution of the stroke, the entire body of the golfer, including the feet, may take part in the movement of the back swing, as well as in the movement of the down swing and the followthrough. Thus, nothing constrains rotation of the golfer's body relative to the ground during any part of the golf stroke. Consequently, the golfer's body is not subjected to strains caused by restraints on free movement. When the golfer lifts his feet so that the spikes 14 are clear of the ground, the plate 11 will be returned to its neutral position by the spring or springs.

The disclosed embodiments are representative of presently preferred forms of the invention, but are intended to be illustrative rather than definitive thereof. The invention is defined in the claims.

I claim:

1. A golf shoe construction comprising an upper having a sole member secured thereto, said sole member having a forward portion for supporting the ball and toes of a person's foot, a rearward portion for supporting the heel of a person's foot, and an intermediate portion for supporting the arch of a person's foot, said forward portion of said sole member having a length greater than the width of said sole member; a rigid spike support plate corresponding substantially in length, width, and shape to that of the forward portion of said sole member; means coupling said support plate to said forward portion of said sole member for rotation about an axis from and to a neutral position in which said support plate is wholly within the confines of said sole member to an adjusted position in which said support plate extends beyond the confines of said sole member; a plurality of spikes carried by said support plate between said axis and the periphery of said support plate and extending therefrom in a direction away from said sole member, said spikes being spaced from one another and non-symmetrically spaced from said axis; bearing means spaced from said axis and interposed between said support plate and said forward portion of said sole member for providing free rotation of said support plate relative to said sole member and support for said support plate during such rotation; and yieldable biasing means reacting between said support plate and said sole member for yieldably maintaining said support plate in and returning said support plate to said neutral position.

2. The construction according to claim 1 wherein said coupling means comprises a pivot forming an axis about which said support plate may rotate.

3. The construction according to claim 2 wherein said support plate mounts a plurality of spikes spaced apart from one another and from said axis.

4. The construction according to claim 1 wherein said support plate mounts a plurality of spikes spaced apart from one another.

5. The construction according to claim 1 wherein said biasing means comprises at least one spring.

6. The construction according to claim 1 wherein said biasing means comprises a plurality of springs.

7. The construction according to claim 1 wherein said sole member has a transverse groove in its lower surface between said forward portion and said intermediate portion to facilitate flexing of said sole member.

8. The construction according to claim 7, said groove being formed rearwardly of said support plate.

9. The construction according to claim 8 wherein said groove extends to both side edges of said sole member, and including elastic means spanning said groove at its opposite ends.

10. The construction according to claim 1 wherein said shoe includes a heel member secured to the rearward portion of said sole member, said biasing means comprising at least one spring extending rearwardly from said support plate and secured to said support plate and one of said members.

11. The construction according to claim 10 wherein said spring is secured to said heel member.

12. The construction according to claim 1 wherein said shoe has a heel secured to the rearward portion of said sole member, said heel being spikeless.

13. The construction according to claim 12 wherein said heel has a forward end sloping to a level corresponding substantially to that of said sole member.

14. The construction according to claim 1 including a shield overlying said biasing means.

* * * * *